US005385234A

United States Patent [19]

Stout et al.

[11] Patent Number: 5,385,234

[45] Date of Patent: Jan. 31, 1995

[54] HEAVY DUTY ARTICLE CARRIER

[75] Inventors: James T. Stout, Ellijay; James B. Demaio, Marietta, both of Ga.

[73] Assignee: The Mead Corporation, Dayton, Ohio

[21] Appl. No.: 115,697

[22] Filed: Sep. 3, 1993

[51] Int. Cl.[6] ..... B65D 75/00

[52] U.S. Cl. ..... 206/427; 229/117.13

[58] Field of Search ..... 206/427; 229/117.13

[56] References Cited

U.S. PATENT DOCUMENTS

| | | | |
|---|---|---|---|
| 4,300,680 | 11/1981 | Champlin | 206/427 |
| 4,577,799 | 3/1986 | Oliff | 229/117.13 X |
| 4,588,084 | 5/1986 | Holley, Jr. | 206/427 |
| 5,197,598 | 3/1993 | Stout et al. | 206/427 X |
| 5,246,112 | 9/1993 | Stout et al. | 206/427 |

FOREIGN PATENT DOCUMENTS

| | | | |
|---|---|---|---|
| 1243987 | 11/1988 | Canada | 206/427 |

*Primary Examiner*—Paul T. Sewell
*Assistant Examiner*—Ted Kavanaugh
*Attorney, Agent, or Firm*—Rodgers & Rodgers

[57] ABSTRACT

The top wall of an article carrier is provided with a pair of hand gripping apertures and score lines extend from the apertures to the corners of the top wall. A supplementary score line extends from a point of intersection with a score line and is arranged to extend beyond the edge of the carrier top wall and to a point of intersection with the top portion of the adjacent side wall at each corner of the carrier. The load of the carrier is well distributed so as to avoid any tendency for the side walls to bow outwardly and thus to interfere with a product removal and reinsertion feature formed in each of the carrier side walls. Efficient distribution of the weight also makes possible the usage of lower caliper board than is usually required for heavy duty carriers while still maintaining package integrity and viability with a product remover and reinsertion structure formed in each carton side wall.

3 Claims, 3 Drawing Sheets

HEAVY DUTY ARTICLE CARRIER

TECHNICAL FIELD

This invention relates generally to hand carried article carriers and is particularly concerned with the construction of hand gripping apertures and related scores formed in the top and side walls of the carrier.

BACKGROUND ART

U.S. patent application Ser. No. 65,277 filed May 21, 1993 now U.S. Pat. No. 5,307,932 and owned by the assignee of this invention discloses and claims a heavy duty article carrier in which special scores are formed in the carrier top wall which cooperate with hand hole apertures to effect efficient distribution of the carrier load.

SUMMARY OF THE INVENTION

A carrier for heavy duty service and having a bottom wall with opposed side and end edges includes opposed side walls and opposed end walls each having bottom, top and end edges interconnected at their end edges with each other and which are foldably joined to the side and end edges of the bottom wall. According to this invention in one form, the top wall of the carrier is a composite structure having a pair of hand hole apertures and arranged to distribute the load in such manner that the carrier may be used effectively with paperboard of a smaller caliper than is presently used for heavy duty service. One feature of this invention concerns the formation of primary scores in the carrier top wall which extend from the region of the hand hole apertures to the corners of the top wall. According to another feature of the invention, a supplementary score line is interconnected with each primary score line at a point of intersection with the primary score line and each such supplementary score line extends across the edge of the carton top wall and into contact with the end edge of each side wall. The primary score lines are formed of first and second parts connected at said point of intersection.

By this invention the usual outward bowing of the side walls is prevented and the tendency for damage to structure which affords access to and reloading of containers whose contents have been used is eliminated.

BEST MODE OF CARRYING OUT THE INVENTION

Figure 1:
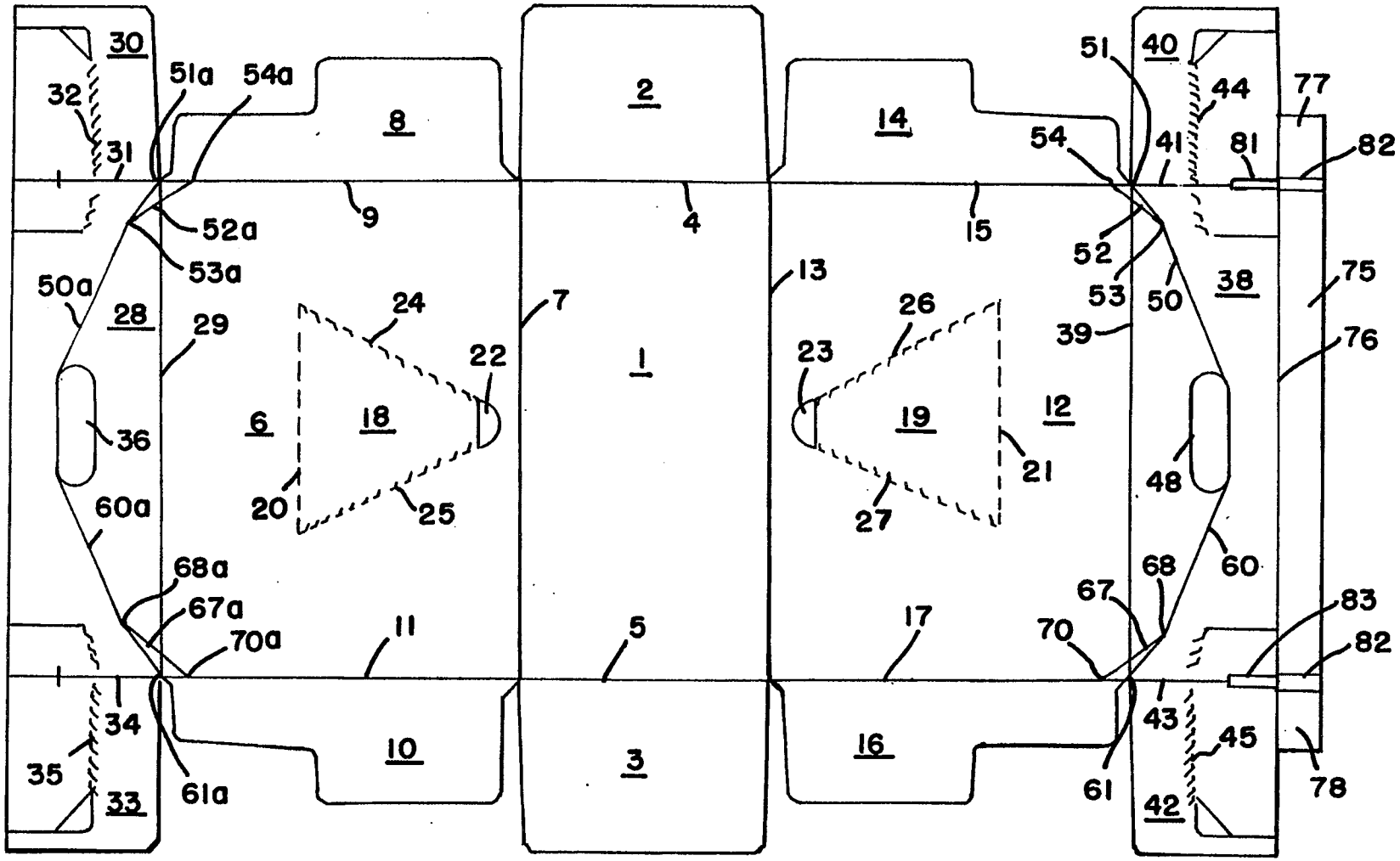
FIG. 1 is a plan view of a blank as seen from the inside.

With reference to FIG. 1 the numeral 1 designates the bottom wall of the carrier and the numerals 2 and 3 designate end flaps foldably joined to the bottom wall 1 along fold lines 4 and 5 respectively. A side wall 6 is foldably joined to a side edge of bottom wall 1 along fold line 7. An end flap 8 is foldably joined to side wall 6 along fold line 9. An end flap 10 is foldably joined to side wall 6 along fold line 11. Side wall 12 is foldably joined to bottom wall 1 along fold line 13 and end flap 14 is foldably joined to side wall 12 along fold line 15.

End flap 16 is foldably joined to side wall 12 along fold line 17. Product removal and reinsertion structures 18 and 19 are formed in side walls 6 and 12 respectively. These structures simply constitute tear lines which interconnect with fold lines 20 and 21. Pull tabs 22 and 23 are provided to impose a tearing force to weakened severance lines 24, 25, 26 and 27 to provide removal and reinsertion of packaged items as is obvious.

The top wall of the carrier is a composite structure and includes panel 28 foldably joined to side wall 6 along fold line 29. End flap 30 is foldably joined to panel 28 along fold line 31 and weakened severance line 32 is formed in end flap 30 and extends into panel 28. At the other side of the blank, end flap 33 is foldably joined to panel 28 along fold line 34 and weakened severance line 35 is formed in panel 33 and extends into top panel 28. A hand gripping aperture 36 is formed in panel 28.

At the other end of the blank panel 38 is foldably joined to side wall 12 along fold line 39. End flap 40 is foldably joined to panel 38 along fold line 41 and a weakened severance line 44 is formed in flap 40 and extends into panel 38. End flap 42 is foldably joined to panel 38 along fold line 43. A weakened severance line 45 is formed in end flap 42 and extends into panel 38. A hand hole aperture 48 is formed in panel 38.

A primary score line 50 is provided in accordance with this invention and extends from one end of hand hole aperture 48 to the adjacent corner 51. A supplementary score line 52 intersects primary score line 50 at a point of intersection 53 and supplementary score line 52 extends across the edge 39 of panel 38 and intersects the end edge of side wall 12 at point 54. Primary score line 50 includes a first part which extends from hand hole aperture 48 to the point of intersection 53. Primary score line 50 includes a second part which extends from point of intersection 53 to corner 51 of panel 38.

Similarly on the other side of the panel 38 a primary score line 60 extends from one end of hand hole aperture 48 to the corner 61 of panel 38. A supplementary score line 67 extends from a point of intersection 68 with primary score 60 to cross the edge 39 of panel 38 to intersect the side wall 12 at 70.

The score lines associated with panel 28 and side wall 6 are identified with the same numerals as are used to identify the score lines associated with panel 38 except the suffix "a" is used to identify score lines associated with panel 28.

These particular score lines constitute a major feature of this invention and have been found to strengthen greatly the overall integrity of the carrier thus to make possible the use of board of a lower caliper than is normally required for this type of service.

A reinforcing strip 75 is foldably joined to panel 38 along fold line 76. End flaps 77 and 78 are foldably joined to the ends of reinforcing strip 75. Reinforcing strip 75 including end panels 77 and 78 are folded upwardly and to the left along fold line 76. This folding operation causes the debossed structure 82 to coincide with embossed line 81 and causes the debossed structure 82 to overly the embossed strip 83. The panel 38 including its end flaps 40 and 42 as well as the reinforcing strip 75 and associated structure are elevated along with side wall 12 and folded along fold line 13 to occupy the position shown in FIG. 2.

Figure 2:
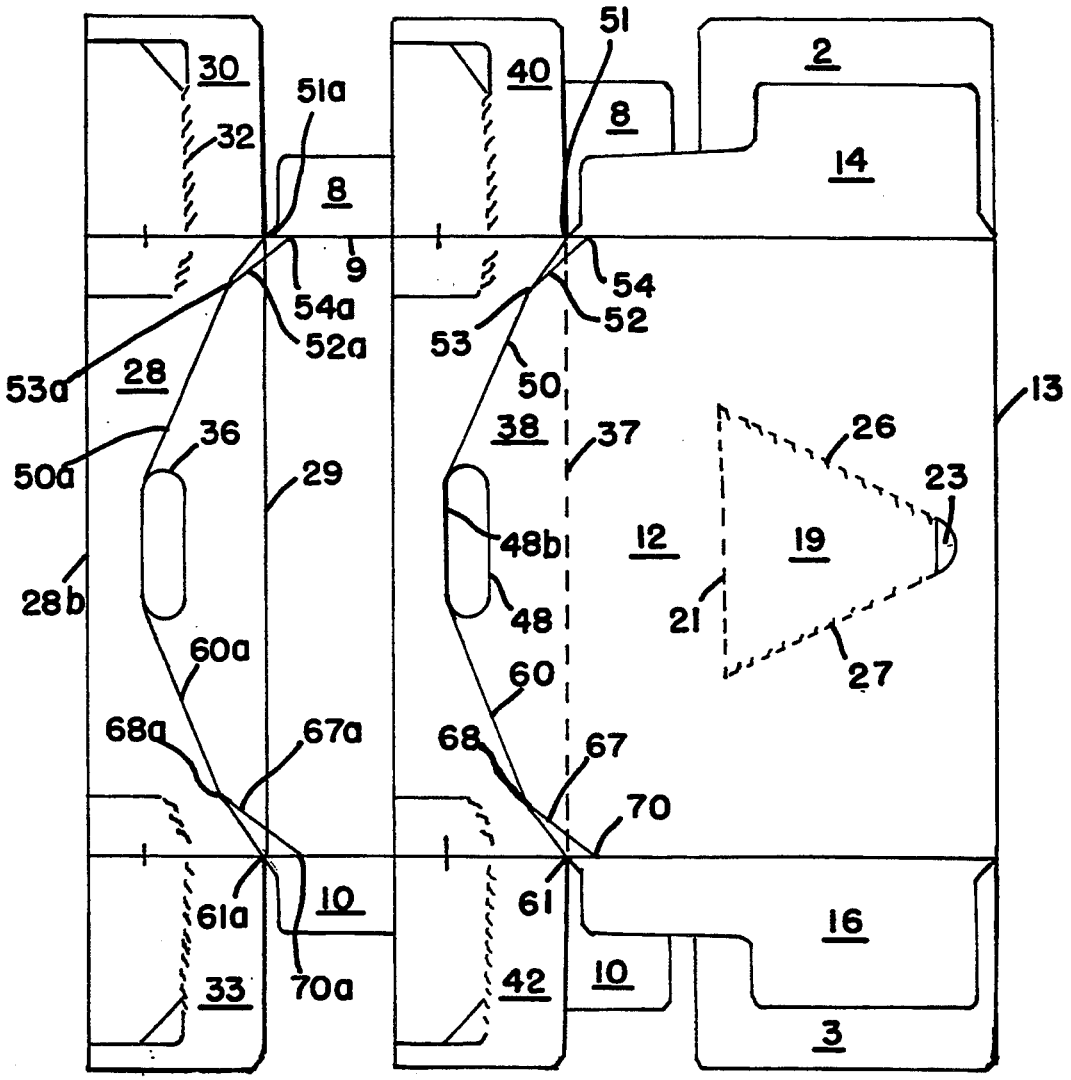
FIG. 2 is a view of the blank shown in FIG. 1 after certain folding operations have been effected and while the carrier is still in collapsed form.

With the components arranged as shown in FIG. 2, panel 28 and end flaps 30 and 33 are elevated and folded to the right along fold line 29. This causes the edge 28*b* of panel 28 to coincide with the side edge 48*b* of hand hole aperture 48 and the structure then appears as shown in FIG. 3.

Figure 4:
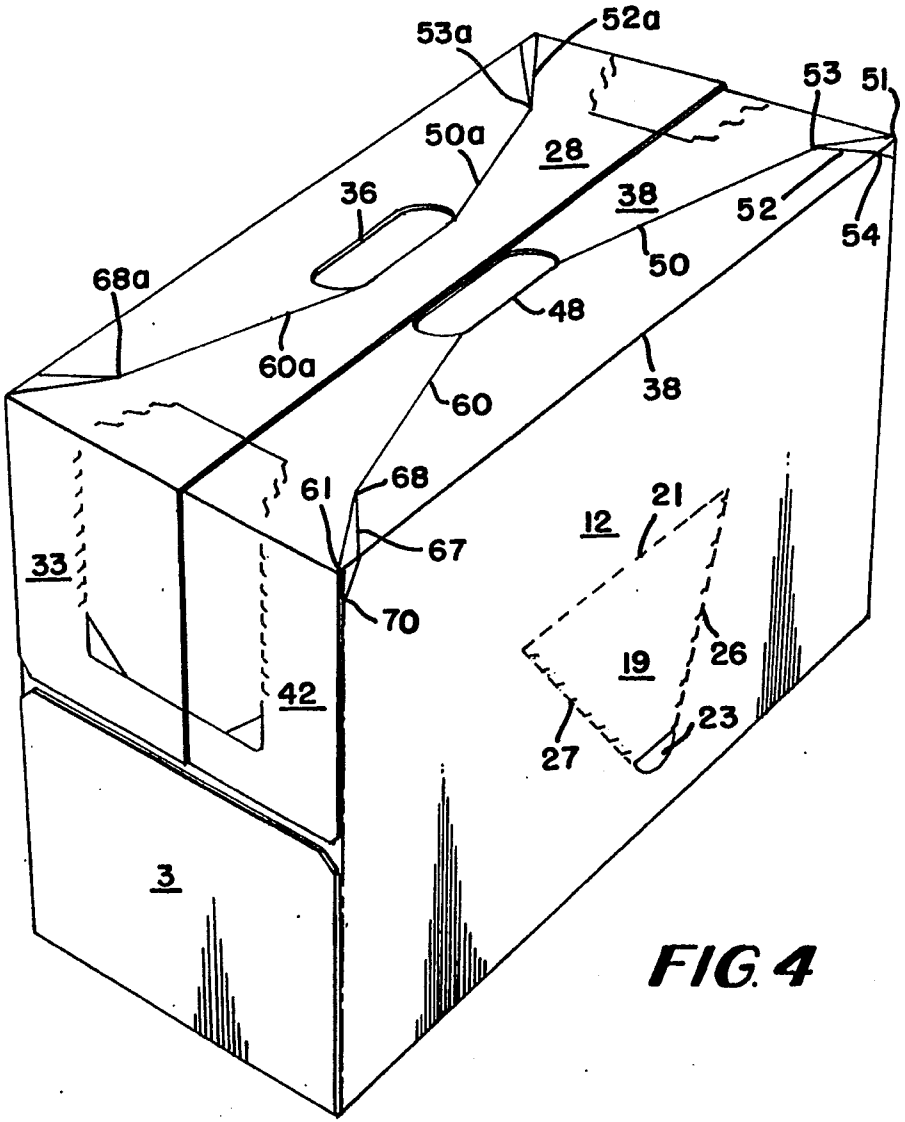
FIG. 4 is a perspective view of the collapsed carrier shown in FIG. 3 in fully set up condition.
Figure 3:
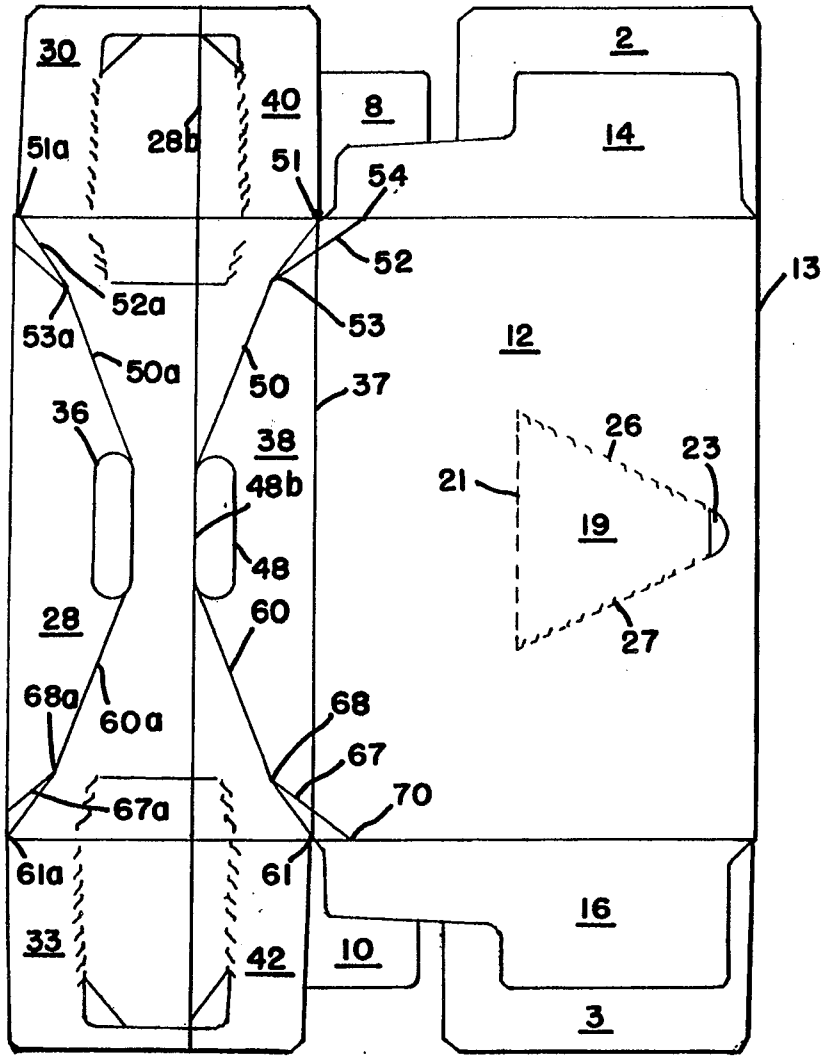
FIG. 3 is a collapsed view of a completed carrier.

When the collapsed carton as shown in FIG. 3 is set up into its fully loaded position, it appears in perspective as shown in FIG. 4. As shown in FIG. 4, the primary score line 50 extends from the hand hole opening 48 to the corner 51 of the top panel 38. The supplementary score 52 interconnects with the primary score 50 at interception point as indicated at 53. This score extends over the corner of panel 38 of the carton and into the end of side wall 12 as indicated at 54. Similar structure as that shown in FIG. 4 in connection with primary score 50 are utilized at each corner of the top wall.

Experience with the structure of this invention has indicated substantial benefits in that the novel structure involving the special score lines in the top wall which extend into the side wall act to distribute the weight very efficiently and thus enable the use of a lower caliper paperboard than is customarily required for structures of this type.

We claim:

1. An article carrier for packaging a plurality of articles and comprising a bottom wall having opposed side and end edges, a bottom end flap foldably joined to each end edge of said bottom wall, side walls having opposed end edges and having top and bottom edges in which each bottom edge is foldably joined to a side edge of said bottom wall, an end wall panel foldably joined along a side edge thereof to each end edge of each of said side walls, a composite top wall having opposed side and end edges foldably joined along its side edges to the top edges of said side walls respectively, a top end flap foldably joined to each end edge of said top wall and secured in flat face contacting relation to each adjacent end wall panel, a pair of finger receiving apertures formed in said top wall, a primary score line formed in said top wall and extending from each end of each of said apertures to the adjacent corner of said composite top wall, and a supplementary score line of similar construction to said primary score lines and extending from a point of intersection with each of said primary score lines at an acute angle thereto and across a side edge of said composite top wall, said primary score line comprising a first part which extends from the associated aperture to said point of intersection and a second part which extends from said point of intersection to the adjacent corner of said composite top wall and said first and said second parts being disposed at an obtuse angle to each other.

2. An article carrier according to claim 1 wherein each of said second parts of each of said primary score lines extends from said point of intersection to each end edge of each of said side walls.

3. An article carrier according to claim 1 wherein each of said second parts of each of said primary score lines extends from said point of intersection to each top edge of each of said side walls.

* * * * *